US008317206B1

(12) United States Patent
Novitzky et al.

(10) Patent No.: US 8,317,206 B1
(45) Date of Patent: Nov. 27, 2012

(54) SKATEBOARD AND STORAGE COMPARTMENT COMBINATION

(75) Inventors: Alexei Novitzky, Tampa, FL (US); Peter Novitzky, Tampa, FL (US)

(73) Assignee: University of South Florida, Tampa, FL (US)

( * ) Notice: Subject to any disclaimer, the term of this patent is extended or adjusted under 35 U.S.C. 154(b) by 147 days.

(21) Appl. No.: 12/943,531

(22) Filed: Nov. 10, 2010

Related U.S. Application Data

(60) Provisional application No. 61/259,643, filed on Nov. 10, 2009, provisional application No. 61/347,605, filed on May 24, 2010.

(51) Int. Cl.
*A63C 17/00* (2006.01)

(52) U.S. Cl. ..... 280/87.042; D21/765

(58) Field of Classification Search ..... 280/87.01, 280/87.021, 87.041, 87.042; D21/765
See application file for complete search history.

(56) References Cited

U.S. PATENT DOCUMENTS

| | | | | |
|---|---|---|---|---|
| D287,548 | S | 1/1987 | Kraynack-Simon | |
| 5,413,544 | A * | 5/1995 | Fiore | 482/68 |
| 2005/0275173 | A1 * | 12/2005 | Hernandez et al. | 280/32.6 |
| 2008/0042387 | A1 | 2/2008 | Lesko | |

* cited by examiner

*Primary Examiner* — John Walters
(74) *Attorney, Agent, or Firm* — David F. Jacobs; Ronald E. Smith; Smith & Hopen, P.A.

(57) ABSTRACT

A skateboard that includes a storage compartment. The deck of the skateboard forms a storage compartment and includes a bottom panel, a sidewall, and a top panel. The sidewall extends upwardly from, and is disposed along, the periphery of the bottom panel. The top panel is hingedly connected to the sidewall and opens and closes to form a storage compartment in conjunction with the sidewall and bottom panel. A latch is used to securely fasten the top panel in the closed position. A handle is provided to carry the skateboard like a suitcase.

6 Claims, 5 Drawing Sheets

SKATEBOARD AND STORAGE COMPARTMENT COMBINATION

CROSS REFERENCE TO RELATED APPLICATIONS

This application claims priority to now abandoned U.S. provisional patent application No. 61/259,643, entitled "SKATE-CASE," filed on Nov. 10, 2009, the contents of which are hereby incorporated by reference. This application also claims priority to currently pending U.S. provisional patent application No. 61/347,605, entitled "SKATEBOARD WITH A BUILT IN COMPARTMENT FOR STORAGE," filed on May 24, 2010, the contents of which are hereby incorporated by reference.

BACKGROUND OF THE INVENTION

1. Field of the Invention

This invention relates to a skateboard. More specifically, this invention relates to a skateboard that includes a storage compartment.

2. Description of the Prior Art

Skateboards are one of the most popular forms of human powered sports and recreational devices that are used by a rider to move himself or herself across the ground or other surface. The standard skateboard has an elongated platform having a top surface on which the rider stands and a bottom surface that connects to one or more wheel assemblies that rollingly engage the ground or other support surface. The platform is sized to allow the rider to be able to place all or a portion of both of his or her feet on the upper surface when riding the skateboard. As well known by persons familiar with skateboards, the rider uses one of his or her feet to propel the skateboard and uses the tilting action of his or her body, usually with both feet generally transversely disposed on the platform, to change the skateboard's direction of travel. Although in the past the platform was almost always configured to be substantially planar and made out of wood, modern skateboards are known to have a variety of shapes, including generally uplifting ends, and be made out of a variety of different types of materials, including various metal, thermoplastic and composite materials. The typical wheel assembly includes a pair of truck mechanisms having a plurality of wheels, typically two for each truck, that are rotatably connected to the truck axle. For the standard skateboard, the truck mechanisms are fixedly attached to the underside of the board with mechanical connectors, such as rivets, screws or bolts, or specially configured adhesives. Some modem skateboards are configured with truck assemblies that provide for a pivoting type of motion relative to the plane of the surface on which the skateboard is being ridden to allow the rider more control of the skateboards movement.

Although skateboard riding is popular among people of all ages, it tends to be most popular among younger riders who like to ride the skateboard as a means of transportation to get to school, stores, after school sports practices, movies, and other activities in addition to use for general recreation. A significant problem for use of a skateboard for transportation, for rider of all ages, is what to do with belongings and other items while riding. Many riders wear backpacks or carry their belongings in a bag. This can cause the rider to become unbalanced and is dangerous.

Accordingly, what is needed is a skateboard that provides sufficient storage. However, in view of the prior art considered as a whole at the time the present invention was made, it was not obvious to those of ordinary skill in the art that a skateboard could serve as a transportation means as well as a storage unit. It was therefore not obvious how a skateboard could be transformed into a storage unit without adversely impacting upon its utility as a transportation means.

SUMMARY OF THE INVENTION

The long-standing but heretofore unfulfilled need for a skateboard that provides storage for miscellaneous items of the type often carried by skateboard users is now met by a new, useful, and nonobvious invention.

The claimed invention is a skateboard that includes a storage compartment. Specifically, the deck of the skateboard forms a storage compartment and includes a bottom panel, an upstanding sidewall, and a top panel. The sidewall is mounted about the periphery of the bottom panel and forms a lip. The top panel is hingedly connected to the sidewall and opens and closes to form a storage compartment in conjunction with the sidewall and bottom panel. A latch is used to securely fasten the top panel in the closed position.

In a first embodiment, the skateboard includes a handle disposed on the sidewall of the deck and allows a user to carry the skateboard (and items stored within the storage compartment) like a briefcase. Moreover, a means for securely fastening the storage compartment in the closed position is provided so the skateboard can be carried like a briefcase without the contents of the storage compartment falling out.

In a second additional embodiment, the storage compartment includes spacers to allow compartmentalization of the storage compartment.

In a further embodiment, the appearance of the skateboard is that of a briefcase; for example, it may be decorated with different colors, designs, and materials.

The sizes of the storage compartment may vary as it is applied to both skateboards and long-boards (a type of skateboard that is similar to a surfboard with wheels) that vary in length. Accordingly, the long-board will have a greater storage capacity than the skateboard.

The claimed invention is used as a carrying device, i.e.—a briefcase for storing items. It is also used as a transportation device, i.e.—ridden like a skateboard or long-board.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
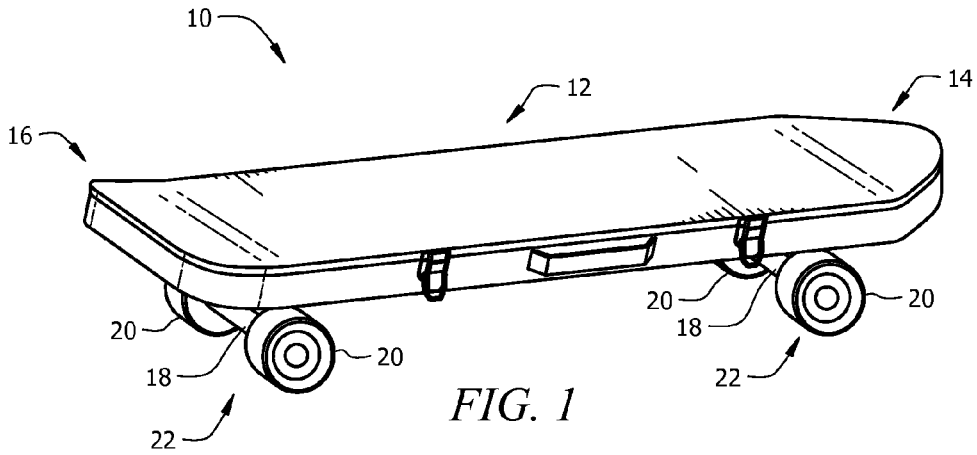
FIG. 1 is an upper perspective view of a skateboard that depicts a storage compartment in the closed position.

The claimed invention is a skateboard and storage compartment combination. Referring to FIG. 1, there is shown a skateboard, generally designated as 10, including the conventional skateboard features of deck 12, nose 14, tail 16, and wheel assembly 22 (which includes wheel trucks 18 and wheels 20). Like any skateboard, a user stands on deck 12 and uses a foot to propel the skateboard and uses the tilting action of the body, usually with both feet generally transversely disposed on deck 12, to change the skateboard's direction of travel.

Figure 2:
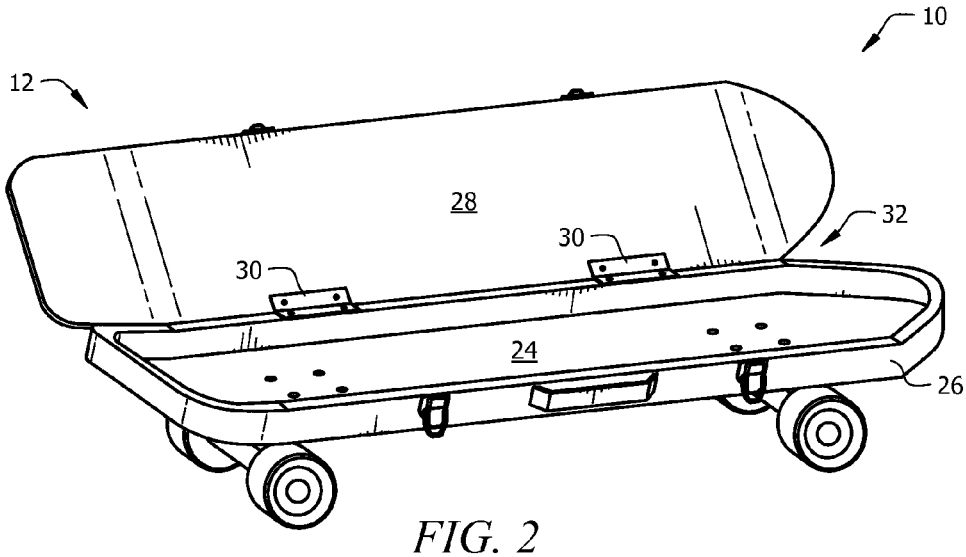
FIG. 2 is an upper perspective view of a skateboard that depicts a storage compartment in the open position.

As depicted in FIG. 2, deck 12 includes bottom panel 24, sidewall 26, and top panel 28. Sidewall 26 extends upwardly from bottom panel 24 and is disposed along the periphery of bottom panel 24 to form a lip along bottom panel 24. Top panel 28 is hingedly connected to sidewall 26 via hinge 30 and opens and closes to form storage compartment 32 in conjunction with sidewall 26 and bottom panel 24. In the closed position, bottom panel 24 and top panel 28 are spaced apart from each other.

Figure 3:
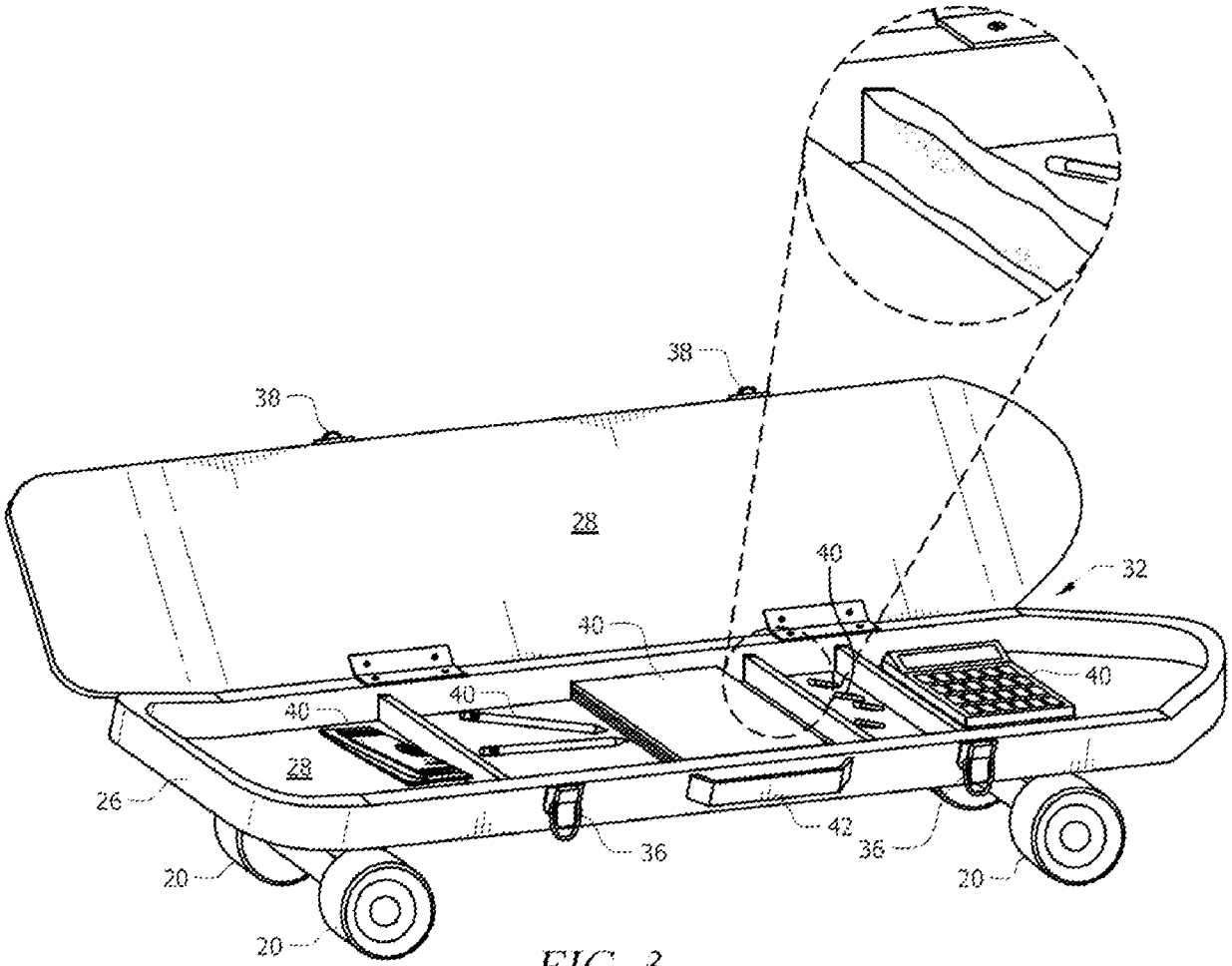
FIG. 3 is an upper perspective view of a skateboard that depicts a storage compartment in the open position filled with items for storage.

In the open position, as depicted in FIG. 3, a user is able to place items 40 for storage in storage compartment 32. Depending on the size and type of board (skateboard or longboard) storage compartment 32 will vary in size. Accordingly, items 40 may range from large (e.g., a computer) to small (e.g., a pen).

Figure 4:
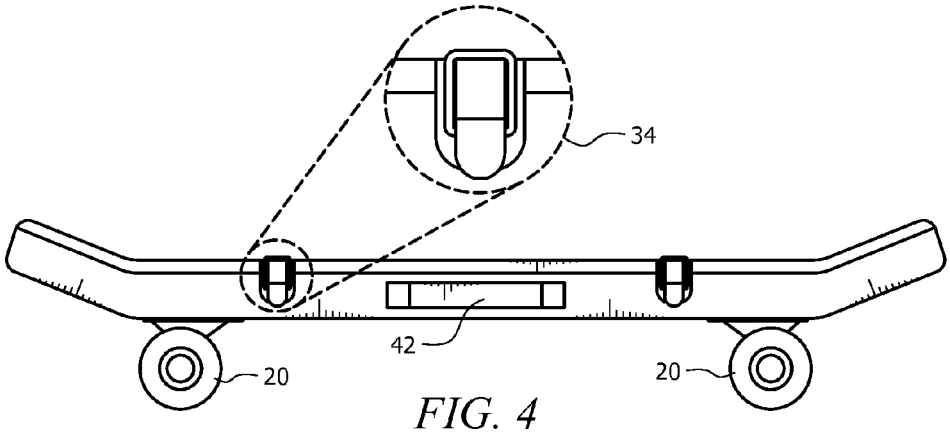
FIG. 4 is a first side view of a skateboard that depicts a storage compartment in the closed and latched position.

As depicted in FIGS. 3 and 4, to prevent top panel 28 from freely moving between the open and closed position, fastening mechanism 34 is used to securely fasten top panel 28 in the closed position. For example, fastening mechanism 34 includes catch 36 disposed on sidewall 26 and latch 38 disposed on top panel 28. Latch 38 is lowered into catch 36 and fastened together to hold top panel 28 securely against sidewall 26. Although fastening mechanism 34 is depicted as a catch and latch, any fastening means may be used; for example, a magnetic fastening means, a lock and key, screw, peg, clamp, etc.

Figure 6:
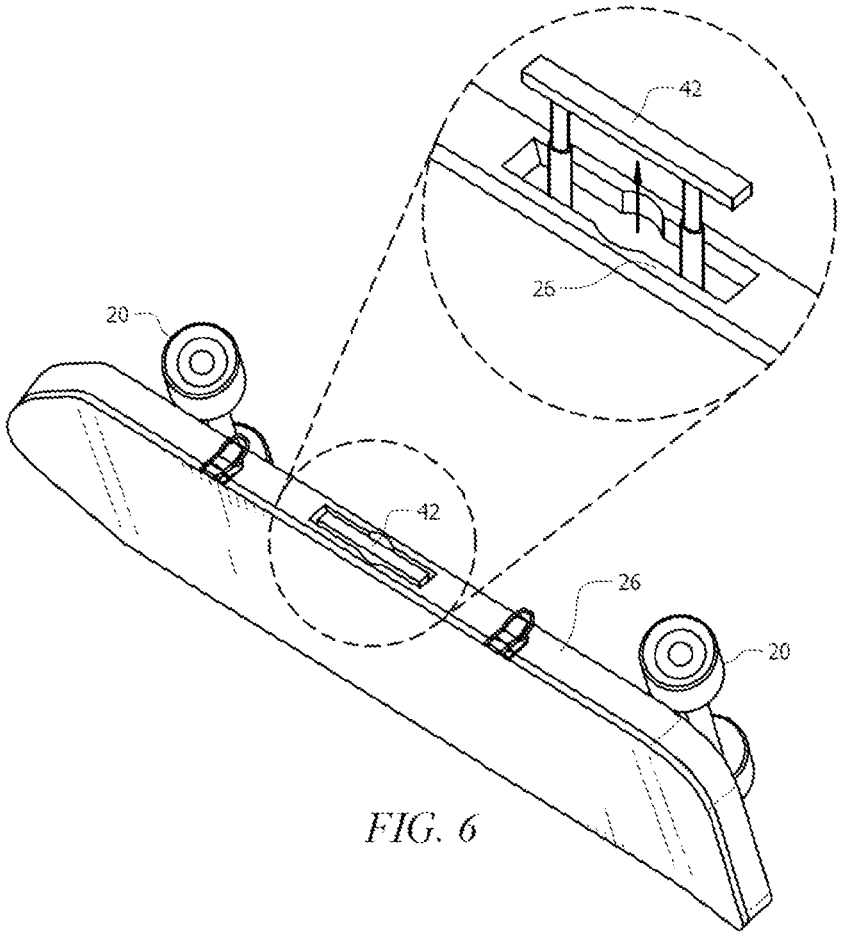
FIG. 6 is a third side view of a skateboard depicting a handle that is flush with the skateboard when retracted but which projects therefrom when accessed.

Still referring to FIGS. 3 and 4, handle 42 is disposed on sidewall 26. Handle 26 allows a user to carry the skateboard (and items stored within the storage compartment) like a briefcase. Handle 42 may be rigid or flexible. In an embodiment depicted in FIG. 6 handle 42 rests within a recess in sidewall 26 such that it is flush when not being used and pops outs when needed. Moreover, a long strap may also be incorporated such that a user can carry the skateboard over the shoulder.

Figure 5:
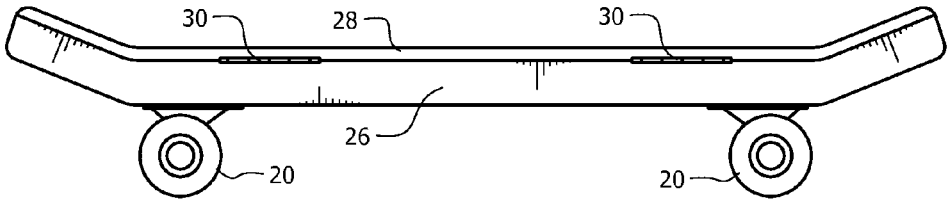
FIG. 5 is a second side view of a skateboard that depicts a storage compartment in the closed position.

As depicted in FIG. 5, hinge 30 hingedly connects top panel 28 with sidewall 26 and allows top panel 28 to open and close.

In an embodiment depicted in FIG. 3 the storage compartment 32 includes a plurality of spacers to help separate stored items in order to maintain proper arrangement. Compartment 32 may also include a soft, shock-absorbent material to protect the stored items. It may further be water resistant/proof in order to protect stored items.

Figure 7:
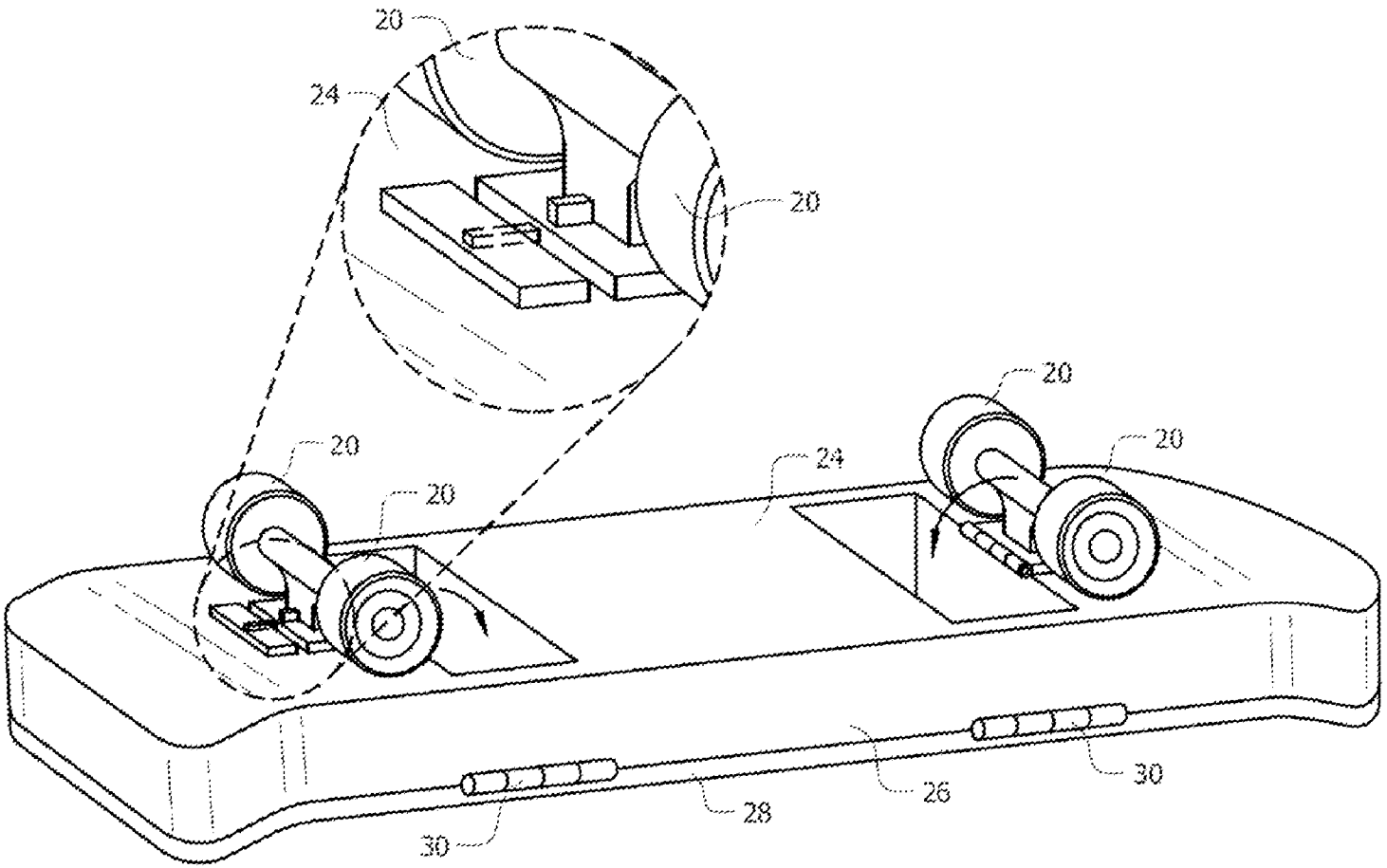
FIG. 7 is a bottom view of a skateboard depicting foldable wheels.

In an embodiment illustrated in FIG. 7 the truck and wheels may be folded into a recess in bottom panel 24 so that when a user is holding the skateboard there are no apparent wheels.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween

What is claimed is:

1. A skateboard, comprising:

a skateboard deck having a bottom panel, a sidewall, and a top panel, said sidewall extending upwardly from said bottom panel and being mounted about a periphery of said bottom panel to form a lip along said bottom panel, said top panel being hingedly connected to said sidewall to form a storage compartment in conjunction with said sidewall and said bottom panel; and said top panel having a top surface on which a rider stands and said bottom panel having a bottom surface connected to at least two wheel assemblies adapted to rollingly engage a support surface.

2. A skateboard as in claim 1, further comprising:

a handle disposed on said sidewall of said skateboard deck, whereby said handle is used to carry said skateboard.

3. A skateboard as in claim 2, further comprising:

a recess in said sidewall for housing said handle while not in use.

4. A skateboard as in claim 1, further comprising:

a latching mechanism for securely fastening said top panel to said sidewall when said top panel is in a closed position.

5. A skateboard as in claim 1, further comprising:

at least one spacer disposed within said storage compartment, whereby said at least one spacer compartmentalize said storage compartment.

6. A skateboard as in claim 1, further comprising:

a recess in said bottom panel to house said wheel assemblies when said wheel assemblies are not in use.

* * * * *